US007743822B2

(12) United States Patent
Artherholt

(10) Patent No.: US 7,743,822 B2
(45) Date of Patent: Jun. 29, 2010

(54) SNUBBER SPOOL WITH DETACHABLE BASE PLATES

(75) Inventor: Danny Lee Artherholt, Asher, OK (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 165 days.

(21) Appl. No.: 11/951,065

(22) Filed: Dec. 5, 2007

(65) Prior Publication Data

US 2009/0145593 A1 Jun. 11, 2009

(51) Int. Cl.
*E21B 19/22* (2006.01)
*E21B 37/06* (2006.01)

(52) U.S. Cl. ..... 166/77.1; 166/379

(58) Field of Classification Search ..... 166/77.51, 166/379, 382, 85.1, 377, 77.1, 96.1; 414/22.51; 251/1.1

See application file for complete search history.

(56) References Cited

U.S. PATENT DOCUMENTS 1,343,426 A * 6/1920 Wright ..... 166/85.1
2,220,359 A * 11/1940 Tschappat ..... 166/88.3
3,188,708 A * 6/1965 O'Haver ..... 175/424
3,999,610 A 12/1976 Sage et al.
5,568,837 A 10/1996 Funk
6,412,560 B1 7/2002 Bernat
6,626,245 B1 9/2003 Dallas
6,681,894 B1 * 1/2004 Fanguy ..... 182/113
6,695,064 B2 2/2004 Dallas
6,712,147 B2 3/2004 Dallas
6,817,423 B2 11/2004 Dallas
6,827,147 B2 12/2004 Dallas
6,834,717 B2 * 12/2004 Bland ..... 166/78.1
6,857,471 B2 * 2/2005 Thangarasu et al. ..... 166/75.14
6,948,565 B2 9/2005 Dallas
7,168,495 B2 1/2007 Dallas et al.
7,210,525 B2 5/2007 Dallas
7,448,444 B2 * 11/2008 Thomson et al. ..... 166/75.14
2003/0102136 A1 * 6/2003 Nelson et al. ..... 166/387
2005/0077039 A1 * 4/2005 Shahin et al. ..... 166/77.53
2006/0102337 A1 * 5/2006 Elliott et al. ..... 166/77.51
2008/0196882 A1 * 8/2008 McGuire et al. ..... 166/85.1

* cited by examiner

*Primary Examiner*—David J Bagnell
*Assistant Examiner*—Kipp C Wallace
(74) *Attorney, Agent, or Firm*—Nelson Mullins Riley & Scarborough, LLP

(57) ABSTRACT

A snubber spool with detachable base plates includes a base flange with a plurality of spaced-apart load pins received in through bores in the base plates. Tie plates with bores for receiving top ends of the load pins are mounted over the base plates in an offset orientation with respect to the base plates. A load nut that engages a pin thread on an outer sidewall of the snubber spool is tightened down on the tie plates to lock the base plates to the snubber spool.

20 Claims, 11 Drawing Sheets

SNUBBER SPOOL WITH DETACHABLE BASE PLATES

RELATED APPLICATIONS

This is the first application filed for this invention.

FIELD OF THE INVENTION

This invention relates in general to equipment used for hydrocarbon well completion, re-completion or workover and, in particular, to a snubber spool with detachable base plates.

BACKGROUND OF THE INVENTION

As is well known, all hydrocarbon wells require completion, and most wells require re-completion or workover. It is also well known that these operations are preferably performed without killing the well. Most completion, re-completion and workover operations require that a high-pressure mandrel or tubing, often with attached downhole tool(s), be stroked into or out of a wellhead or a wellbore while downhole fluids under pressure are controlled. In order to ensure that the well fluids do not escape to atmosphere, well control equipment such as blowout preventers (BOPs) must be used to control the well while a rig, jacks or hydraulic cylinders are used to move the high-pressure mandrel or tubing as desired. Although stacks of two or more BOPs can be used to control a well when tubing and/or downhole tool(s) are being inserted into or removed from a well, it is often more economical to use a "snubber spool" in conjunction with a single BOP for well control.

A snubber spool, also referred to as an "anchor spool", is described in Assignee's U.S. Pat. No. 7,210,525 which issued on May 1, 2007 and is entitled Apparatus For Controlling A Tool Having A Mandrel That Must Be Stroked Into Or Out Of A Well, the entire specification of which is incorporated herein by reference.

FIG. 1 is an isometric view of the snubber spool 10 described in Applicant's above-identified United States patent. Affixed to the snubber spool 10 is a base plate 12 that supports a superstructure 30 (FIG. 1A) used to stroke the high-pressure mandrel, tubing, and/or downhole tool(s) connected to the tubing into or out of a wellbore. The base plate 12 is generally oriented at right angles to a port 24 that is used to balance well fluid pressure or to bleed well fluid pressure from the snubber spool 10. The base plate 12 is permanently affixed to the snubber spool 10 and is strengthened and supported by gussets 14*a*, 14*b*, which are welded to an outer sidewall 20 of the snubber spool 10 and to a top surface of the base plate 12. To further strengthen the base plate 12, optional gussets 16*a*, 16*b* may be welded to the outer sidewall 20 and the bottom surface of the base plate 12. The base plate 12 includes through bores 18*a*, 18*b* which receive rod ends 40*a*, 40*b* (FIG. 1*a*) of the superstructure 30 to detachably connect the superstructure 30 to the snubber spool 10.

The pressure balance/bleed port 24 is controlled by a shut-off valve 25. Lifting eyes 26*a*, 26*b* provide convenient attachment points for lifting the snubber spool 10 on to or off of a wellhead, truck or the like. A top end 28 of the snubber spool 10 is configured as required to provide a fluid seal around a tubing or mandrel to be stroked into or out of a wellhead or a wellbore, and to provide a connection for a wellhead isolation tool or any one of many adapters known in the art. In this embodiment the top end of the snubber spool 10 is configured for a threaded connection, but the top end 28 may also terminate in a flange, a Grayloc® connector, or the like.

The superstructure 30 shown in FIG. 1A includes a top plate 32 to which a cylinder end of first and second hydraulic cylinders or screw jacks, 34*a*, 34*b* are affixed by end caps 42*a*, 42*b*. A through bore 44 in the top plate 32 provides a fluid flow path through the top plate 32. An adapter, a swivel, or the like is connected to opposite sides of the top plate in fluid communication with the through bore 44, depending on the job for which the snubber spool 10 is being used. The rod ends 36*a*, 36*b* of the hydraulic cylinders or screw jacks 34*a*, 34*b* are provided with stop collars 38*a*, 38*b* that support the superstructure 30 when the threaded rod ends 40*a*, 40*b* are inserted through the respective bores 18*a*, 18*b* in the base plate 12 and suitable fasteners (not shown) are connected to the threaded rod ends 40*a*, 40*b*to lock the superstructure 30 to the base plate 12.

Alternatively, the superstructure 30 may be connected to the base plate 12 using a quick-connect system shown in FIG. 1*b*. The quick-connect system includes a wing adapter 42 threadedly connected to the threaded rod ends 40*a*, 40*b* (only 40*b* is shown).The wing adapter 42 is threadedly connected to a quick-connect anchor pin 45 received in a through bore 18*c* in the base plate 12. The quick-connect anchor pin 45 is secured to the base plate 12 by an anchor nut 46 that engages a pin thread 48 on an outer periphery of the quick-connect anchor pin 55 above the base plate 12. A hammer nut 50, rotatably supported by the wing adapter 42 engages a pin thread 52 on a top end of the quick-connect anchor pin 45 to detachably lock the rod ends 36*a*, 36*b* (only 36*b* is shown) to the quick-connect anchor pin 45. The hammer nuts 50 are used to quickly connect the superstructure 30 to the base plate 12 and release the superstructure 30 from the base plate 12.

While the snubber spool 10 has proved very useful and commercially successful, the base plate 12 interferes with free movement around the wellhead and complicates handling and transportation of the snubber spool 10.

Therefore there exists a need for a snubber spool with a detachable base plate that can be readily removed when the base plate is not in use.

SUMMARY OF THE INVENTION

It is therefore an object of the invention to provide a snubber spool with detachable base plates that are readily removed from the snubber spool when the base plates are not in use.

The invention therefore provides a snubber spool with detachable base plates, comprising: a base flange affixed to an outer sidewall of the snubber spool, the base flange supporting a plurality of spaced-apart load pins that extend above a top surface of the base flange; at least two base plates respectively having inner ends with a plurality of through bores respectively located to respectively receive one of the load pins; at least two tie plates respectively having a plurality of bores respectively located to respectively receive one of the top ends of the respective load pins; and a load nut having a box thread that engages a pin thread on the outer sidewall of the snubber spool above the base flange; whereby the base plates are mounted over the load pins in a first orientation, the tie plates are mounted over the load pins in a second orientation different from the first orientation, and the load nut is tightened over the tie plates to lock the base plates to the snubber spool.

The invention further provides a snubber spool with detachable base plates, comprising: a base flange affixed to an outer sidewall of the snubber spool, the base flange supporting a plurality of spaced-apart load pins that extend above a top surface of the base flange parallel to the outer sidewall; a pair of base plates respectively having inner ends shaped to collectively surround the outer sidewall of the snubber spool, the inner ends including a plurality of bores respectively located to respectively receive one of the load pins; a pair of tie plates respectively having inner ends shaped to collectively surround the outer sidewall of the snubber spool, the tie plates including a plurality of bores respectively located to respectively receive a top end of one of the load pins; and a load nut having a box thread that engages a pin thread on the outer sidewall of the snubber spool above the base flange; whereby the base plates are mounted over the load pins on opposite sides of the snubber spool in a first orientation, the tie plates are mounted over the load pins on opposite sides of the snubber spool in a second orientation different from the first orientation, and the load nut is tightened over the tie plates to lock the base plates to the snubber spool.

The invention yet further provides detachable base plates for a snubber spool having a base flange affixed to an outer sidewall of the snubber spool with a plurality of load pins retained by a base flange and a load nut having a box thread that engages a pin thread on the outer sidewall of the snubber spool above the base flange, the detachable base plates comprising: at least two base plates respectively having inner ends with a plurality of through bores respectively located to collectively receive a respective one of the plurality of load pins retained by a base flange affixed to an outer sidewall of the snubber spool; and at least two tie plates respectively having a plurality of bores respectively located to respectively receive one of the load pins; whereby the at least two base plates are mounted over the load pins, the tie plates are mounted over the load pins so that joints between the at least two tie plates do not coincide with joints between the at least two base plates, and the load nut is tightened over the tie plates to lock the base plates to the load flange of the snubber spool.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a snubber spool with detachable base plates for supporting a superstructure used to stroke a mandrel, tubing and/or downhole tool(s) into or out of a wellhead or a cased wellbore. The snubber spool includes a base flange that supports a plurality of spaced-apart load pins. The base plates have inner ends with spaced-apart through bores for receiving the load pins. Tie plates with spaced apart bores are placed on top of the base plates so that the load pins are received in the tie plate bores. A load nut threaded to an outer sidewall of the snubber spool is tightened down over the tie plates to secure the base plates to the snubber spool. Since the base plates are easily attached to and detached from the snubber spool, the base plates can be removed any time they are not in use. This permits free movement around the snubber spool so that convenience and safety are enhanced and transportation of the snubber spool is facilitated.

Figure 2:
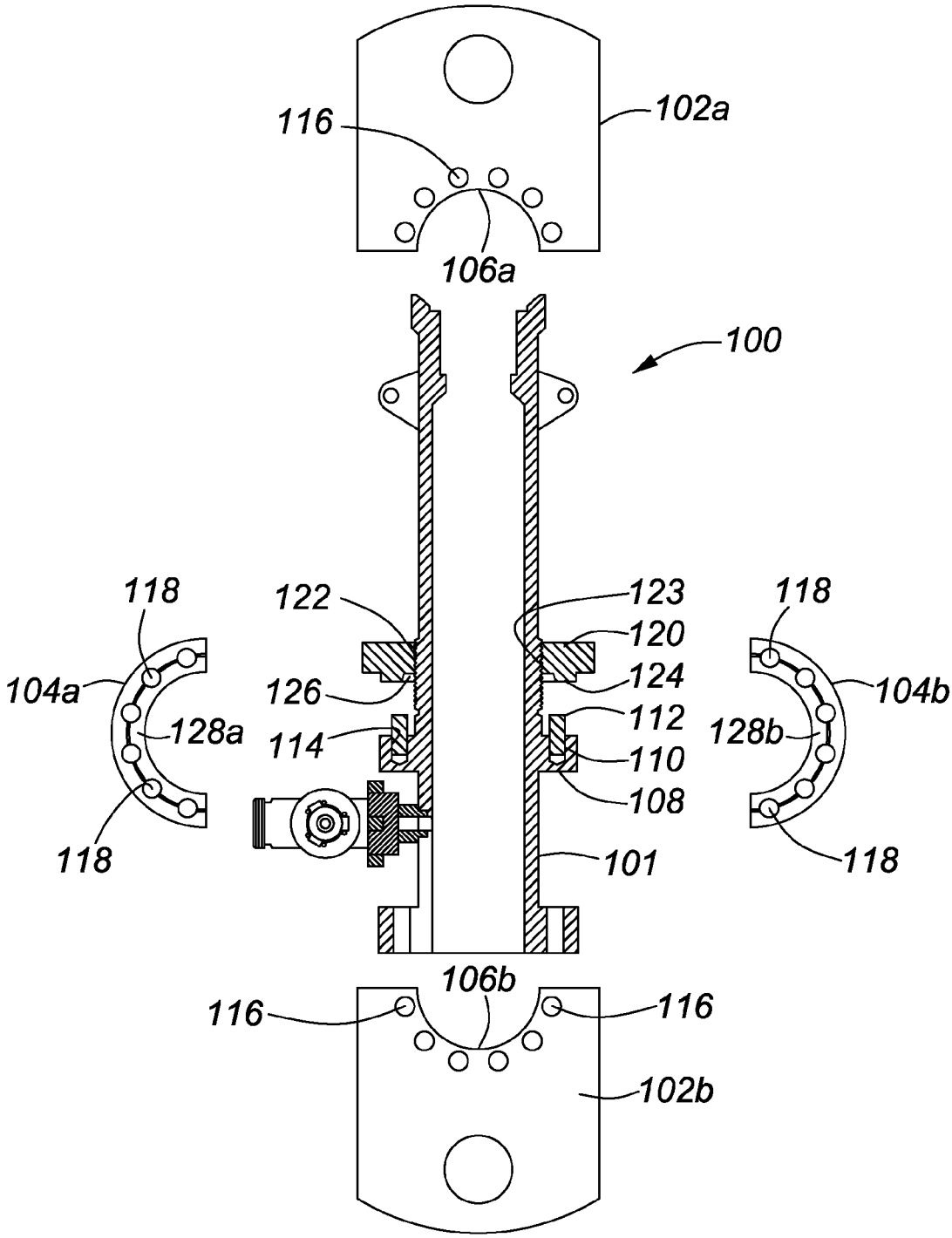
FIG. 2 is a schematic exploded view of a snubber spool with detachable base plates in accordance with one embodiment of the invention, showing the snubber spool in cross-section.

FIG. 2 is a schematic exploded view of a snubber spool 100 with detachable base plates 102*a,* 102*b* in accordance with one embodiment of the invention. The snubber spool 100 is shown in cross-section. Two tie plates 104*a,* 104*b* lock the base plates 102*a,* 102*b* together, as will be explained below in more detail with reference to FIGS. 3-5*a*. The respective base plates 102*a,* 102*b* have inner ends shaped to fit closely around an outer sidewall 101 of the snubber spool 100. In this embodiment, the inner ends of the base plates 102*a,* 102*b* include semicircular recesses 106*a,* 106*b* that receive opposite sides of the outer sidewall 101 of the snubber spool 100. In one embodiment the base plates 102*a,* 102*b* are made of A36 or 4140 steel and are about 2" (5 cm) thick.

The snubber spool 100 has a base flange 108, which may be an integral part of the sidewall 101 or welded to the sidewall 101. The base flange 108 includes a plurality of spaced-apart bores 110 that are parallel to the sidewall 101 and receive load pins 112. In this embodiment, the load pins 112 have pin-threaded bottom ends 114 that engage box threads in the bores 110. However, the load pins 112 may be integrally formed with the base flange 108, welded in the bores 110, or otherwise secured therein in any manner known in the art. In one embodiment, the load pins are made of 4140 steel.

A plurality of spaced apart bores 116 in the inner ends of the base plates 102*a,* 102*b* respectively receive one of the load pins 112. Similar bores 118 in the tie plates 104*a,* 104*b* receive top ends of the load pins 112 after the base plates 102*a,* 102*b* are placed over the load pins 112. A load nut 120 locks the base plates 102*a,* 102*b* and the tie plates 104*a,* 104*b* to the load flange 108. The outer sidewall 101 of the snubber spool 100 includes a pin thread 122 above the load flange 108. The load nut 120 has a box thread 123 that engages the pin thread 122. A bottom surface 124 of the load nut 120 bears on a top surface of the respective tie plates 104*a,* 104*b*. A tie plate cavity 126 receives a tie plate ridge 128*a,* 128*b* on the respective tie plates 104*a,* 104*b* when the tie plate 120 is tightened down to lock the base plates 102*a,* 102*b* to the load flange 108, as will also be explained below in more detail with reference to FIG. 4. In one embodiment, the tie plates 104*a,* 104*b* are about 2" (5 cm) thick, and both the tie plates 104*a,* 104*b* and the load nut 120 are both made of 4140 steel.

Figure 3:
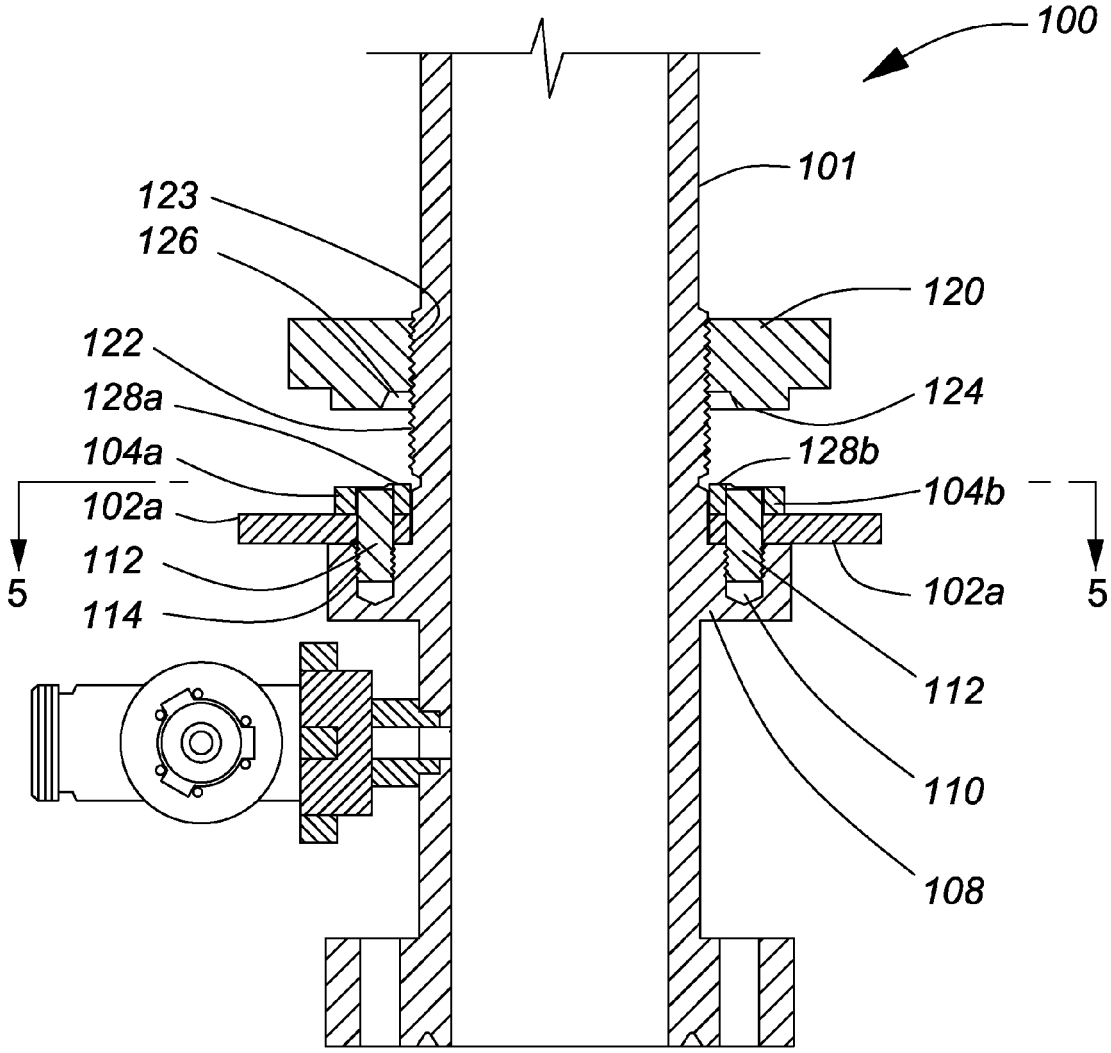
FIG. 3 is a schematic diagram of the snubber spool shown in FIG. 2 with the detachable base plates and tie plates mounted to the snubber spool.

FIG. 3 is a schematic diagram of the snubber spool shown in FIG. 2 with the detachable base plates 102*a,* 102*b* and the tie plates 104*a,* 104*b* mounted to the load flange 108, before the load nut 120 is tightened to lock the base plates 102*a,* 102*b* to the load flange 108. As is apparent, a top end of each of the load pins 112 is received in the respective bores 118 in the respective tie plates 104*a*, 104*b*. However, the top end of the respective load pins 112 does not extend past a top surface of the respective tie plates 104*a*, 104*b*. Consequently, although the bores 118 in the tie plates 104*a*, 104*b* are conveniently through bores, the bores 118 need not extend completely through the tie plates.

Figure 4:
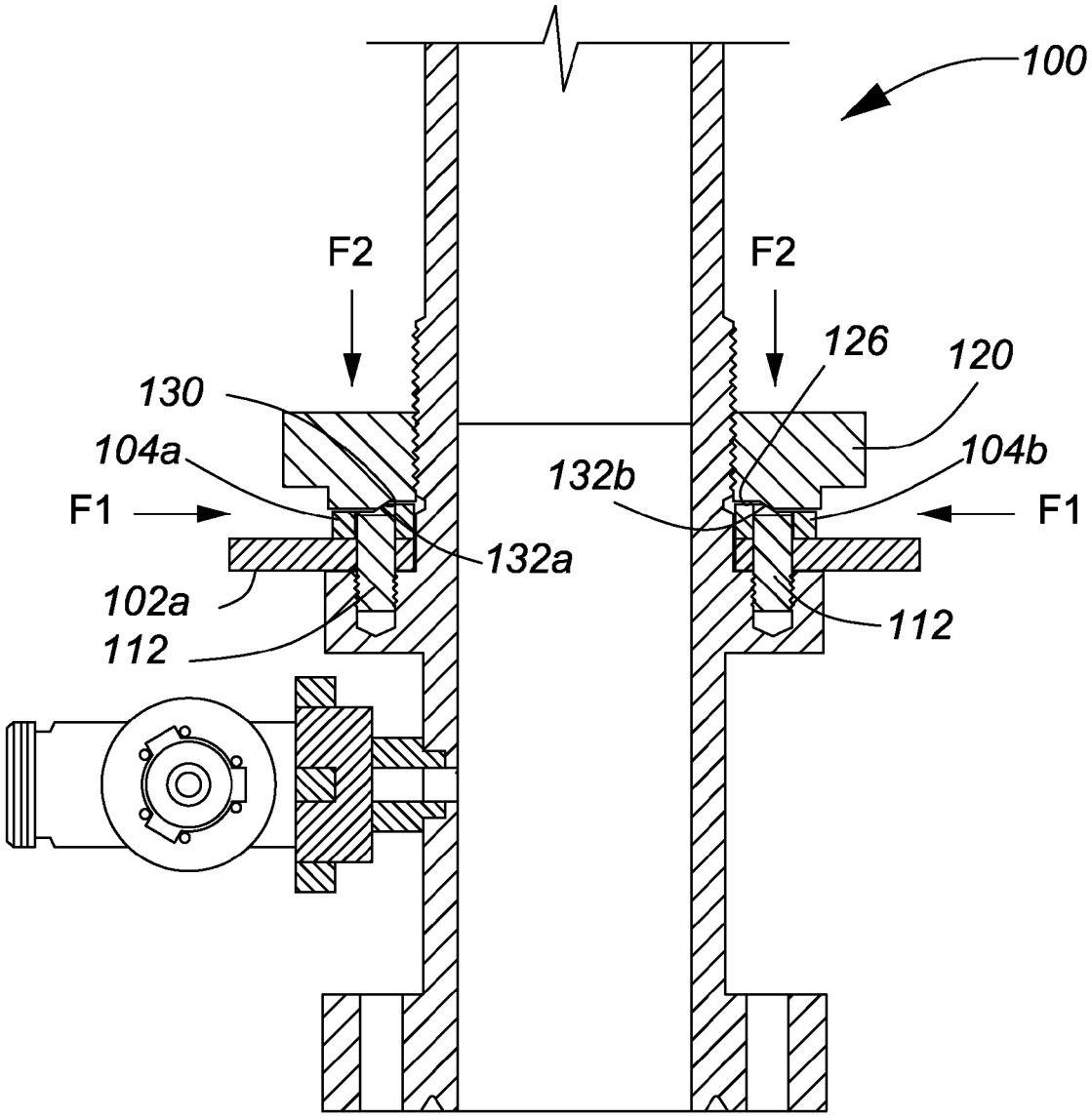
FIG. 4 is a schematic diagram of the snubber spool shown in FIG. 3 with a load nut partially tightened down over the tie plates.

FIG. 4 is a schematic diagram of the snubber spool shown in FIG. 3 with the load nut 120 in a partially tightened down condition in which a load nut ramp 130 contacts tie plate ramps 132*a*, 132*b* on the respective tie plates 104*a*, 104*b*. The tie plate cavity 126 in the bottom of the load nut 120 is shaped so that the load nut ramp 130 applies a radial force F1 against the respective tie plates 104*a*, 104*b* as the load nut 120 is tightened down. The radial force F1 urges the respective tie plates 104*a*, 104*b* against the outer sides of the top ends of the load pins 112 and towards the outer sidewall 101 of the snubber spool 100 to support the load pins 112 against outward bending forces applied by the base plates 102*a*, 102*b* when the superstructure 30 is mounted thereto. As the load nut 120 is further tightened against the top of the tie plates 104*a*, 104*b*, and the bottom of the tie plate cavity 126 contacts a top of the respective tie plate ridges 128*a*, 128*b*. Simultaneously, the bottom surface 124 of the load nut 120 contacts a top surface of the respective tie plates 104*a*, 104*b*. These contacts exert an axial force F2 against a top of the respective tie plates 104*a*, 104*b*. The axial force F2 clamps the base plates 102*a*, 102*b* and the tie plates 104*a*, 104*b* against a top of the load flange 108. This permits the base plates 102*a*, 102*b* to support significant compression and tension loads. Extensive testing has shown that the base plates 102*a*, 102*b* can successfully support substantially the same compression or tension loads as the prior art gusseted base plate described in Assignee's above-referenced United States patent.

Figure 1:
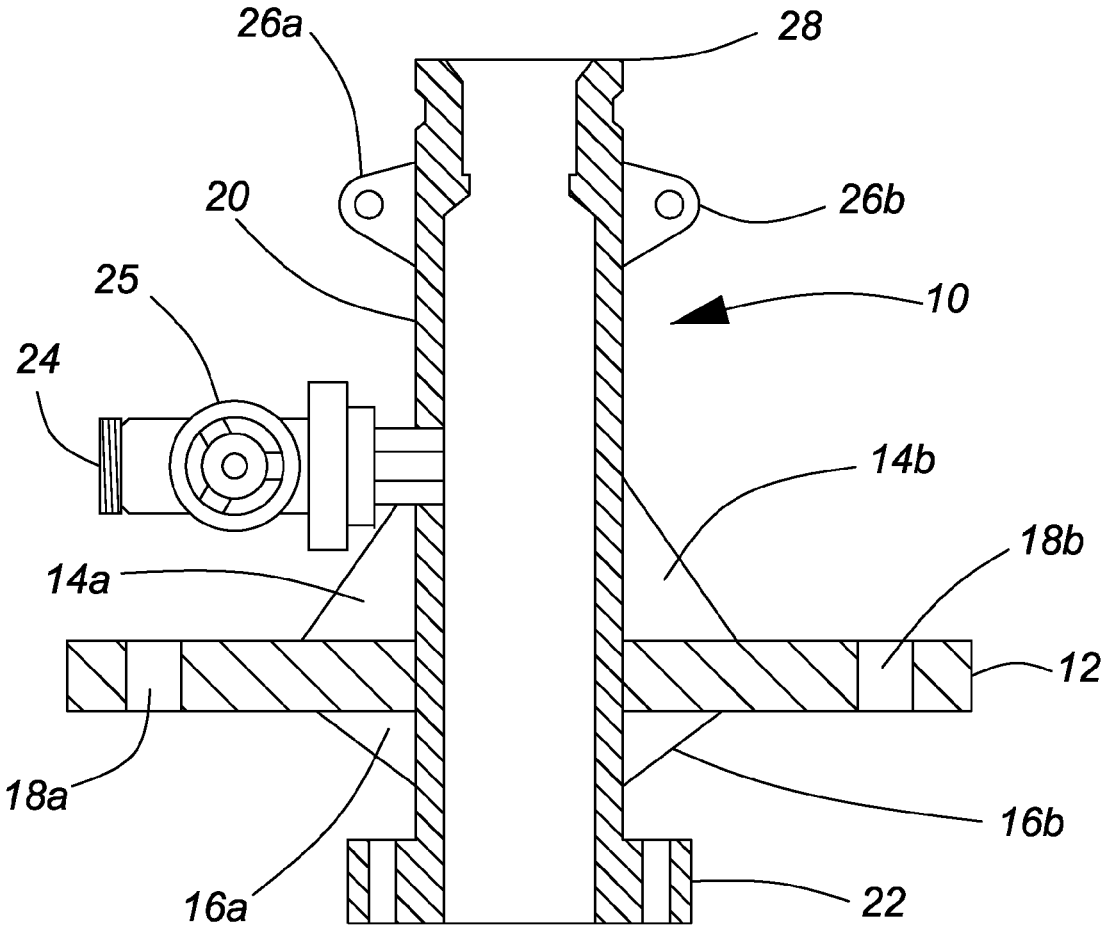
FIG. 1 (PRIOR ART)
FIG. 1 is a schematic isometric cross-sectional diagram of a prior art snubber spool.
Figure 1A:
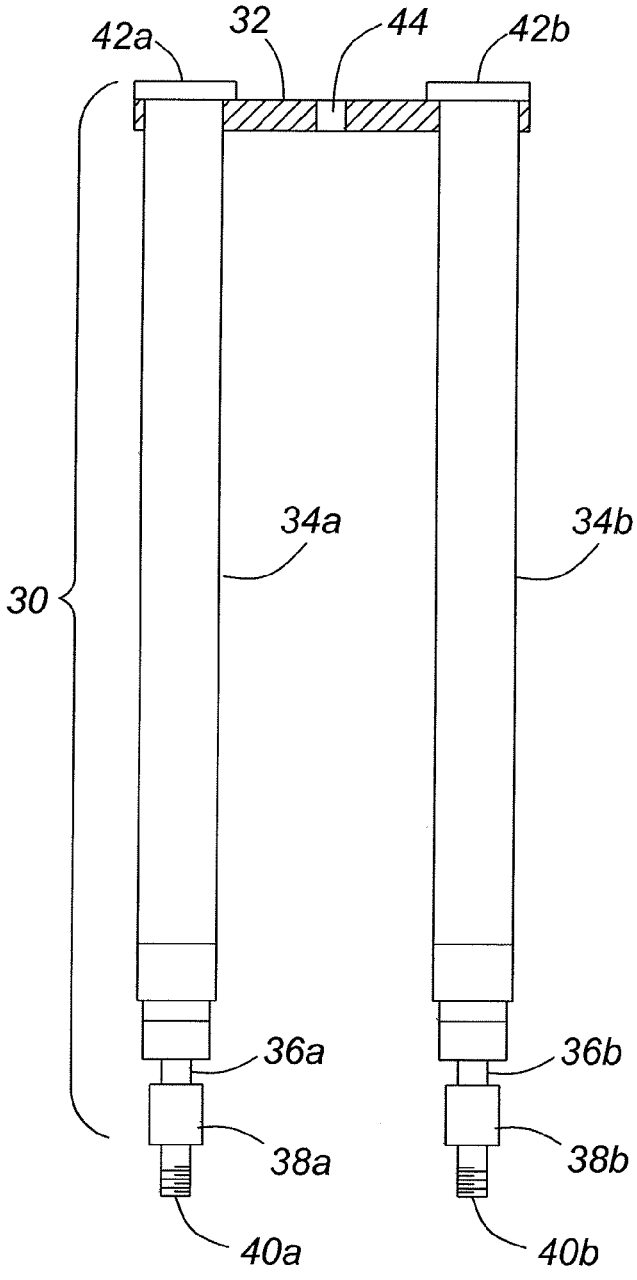
FIG. 1a (PRIOR ART)
FIG. 1*a* is a schematic elevational view of a prior art superstructure that is detachably connected to the snubber spool shown in FIG. 1.
Figure 1B:
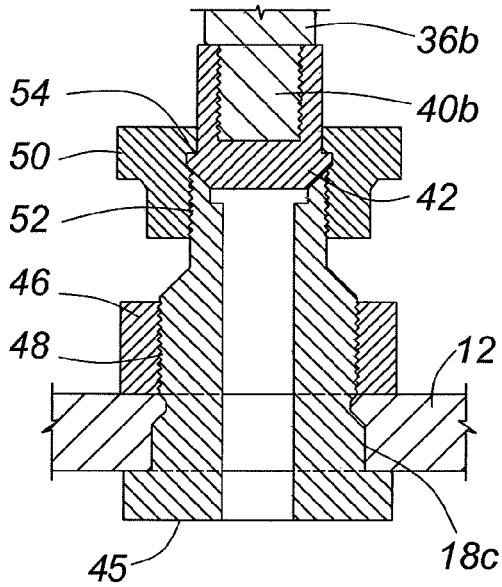
FIG. 1b (PRIOR ART)
FIG 1*b* a schematic cross-sectional diagram of a prior art quick-connect system for the superstructure shown in FIG. 1*a;*
Figure 5A:
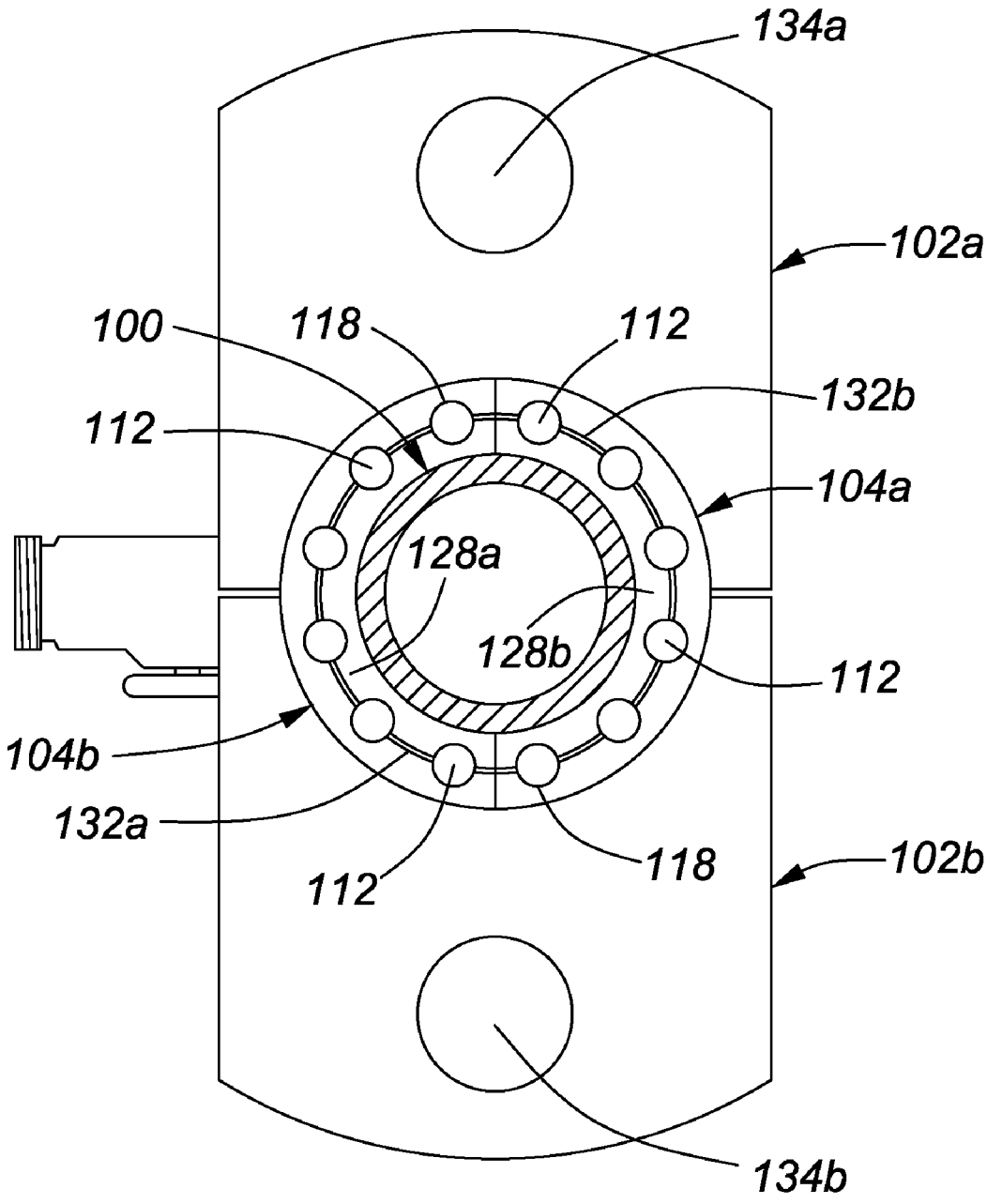
FIG. 5A is a schematic diagram in top plan view of the snubber spool taken along lines 5-5 of the FIG. 3.

FIG. 5A is a schematic diagram in top plan view of the snubber spool 100 taken along lines 5-5 of the FIG. 3. As can be seen, the base plates 102*a*, 102*b* are mounted to the load flange 108 (FIG. 4) in a first orientation and the tie plates 104*a*, 104*b* are mounted over the base plates 102*a*, 102*b* in a second, different orientation. Generally, the tie plates 104*a*, 104*b* are oriented at a 90° offset from the base plates 102*a*, 102*b* though other offsets can also be used so long as joints between the tie plates do not coincide with joints between the base plates. Each base plate 102*a*, 102*b* respectively includes a through bore 134*a*, 134*b* which receives a quick-connect anchor pin 45 or a rod end 40*a*, 40*b* of a hydraulic cylinder, screw jack or a stay rod, as described above with reference to FIGS. 1*a* and 1*b*.

Figure 5B:
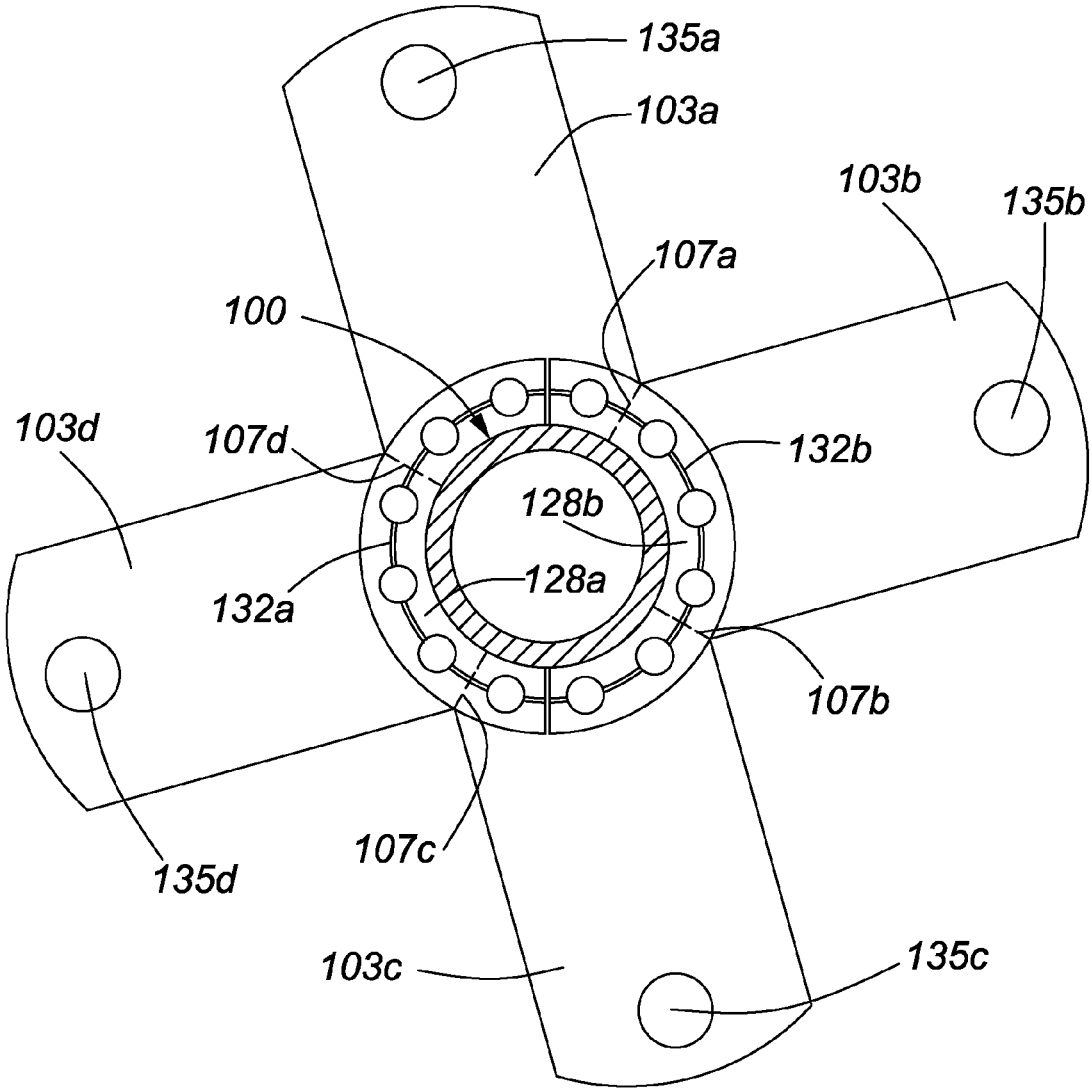
FIG. 5B is a schematic diagram in top plan view of the snubber spool with another embodiment of base plates in accordance with the invention.

FIG. 5B is a schematic diagram in top plan view of the snubber spool 100 with another embodiment of base plates in accordance with the invention. In this embodiment, four base plates 103*a*, 103*b*, 103*c* and 103*d* are provisioned with through bores 135*a*, 135*b*, 135*c* and 135*d* for the connection of four quick-connect anchor pins 45 or the direct connection of four hydraulic cylinders, screw jacks or stay rods, as explained above with reference to FIGS. 1*a* and 1*b*. The inner ends 107*a*, 107*b*, 107*c* and 107*d* of the respective base plates 103*a-d* are shaped so that each base plate closely surrounds about one quarter of the outer sidewall 101 of the snubber spool 100. In this embodiment, the two tie plates 104*a*, 104*b* are used to lock the four base plates 103*a-d* to the snubber spool 100.

Figure 5C:
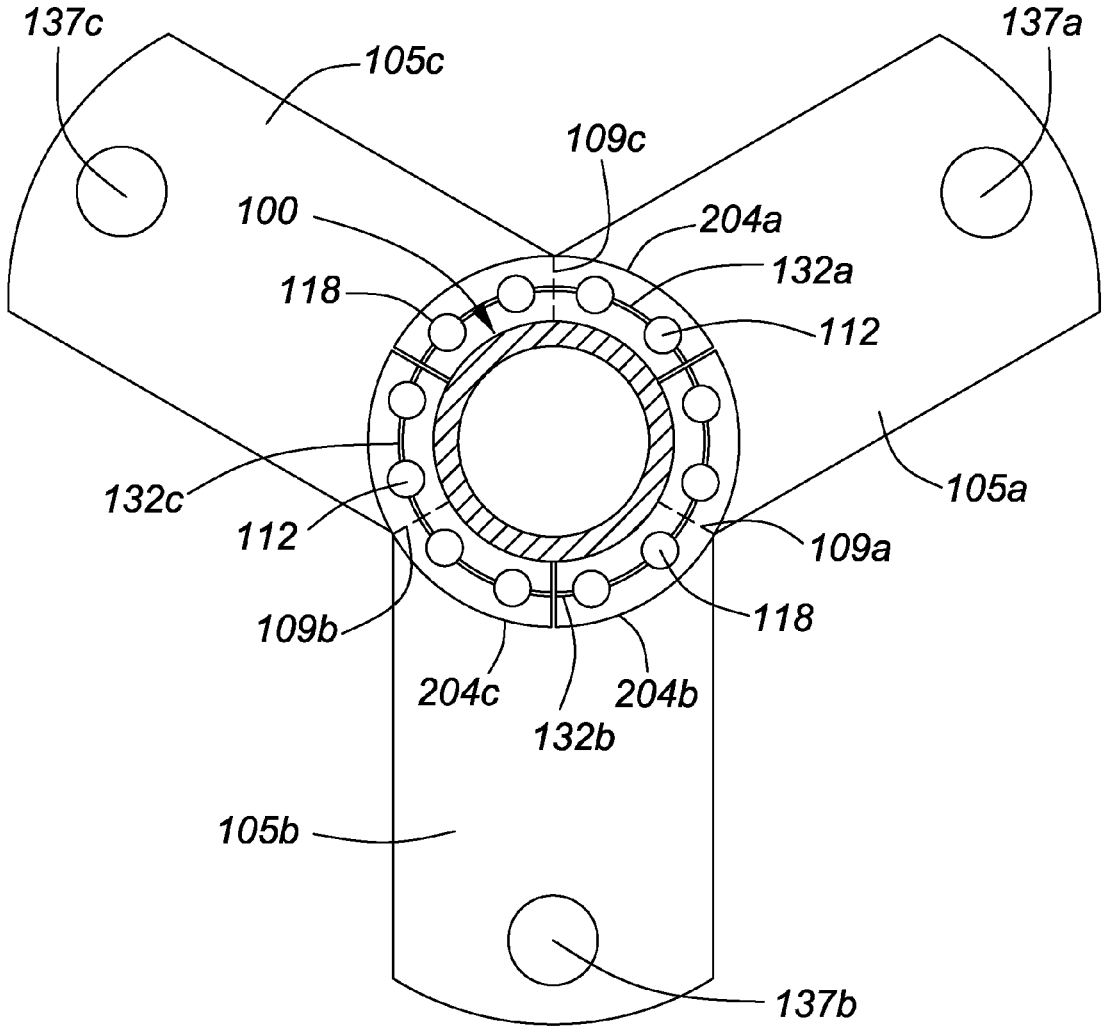
FIG. 5C is a schematic diagram in top plan view of the snubber spool with yet a further embodiment of base plates in accordance with the invention.

FIG. 5C is a schematic diagram in top plan view of the snubber spool 100 with yet a further embodiment of base plates in accordance with the invention. In this embodiment, three base plates 105*a*, 105*b* and 105*c* are provisioned with through bores 137*a*, 137*b* and 137*c* for the connection of three quick-connect anchor pins 45 or the direct connection of three hydraulic cylinders, screw jacks or stay rods, as explained above with reference to FIGS. 1*a* and 1*b*. The inner ends 109*a*, 109*b* and 109*c* of the respective base plates 105*a-c* are shaped so that each base plate closely surrounds about one third of the outer sidewall 101 of the snubber spool 100. In this embodiment, three tie plates 204*a*, 204*b* and 204*c* are used to lock the three base plates 105*a-c* to the load flange 108, although the two tie plates 104*a* and 104*b* could be used with equal success.

Figure 6:
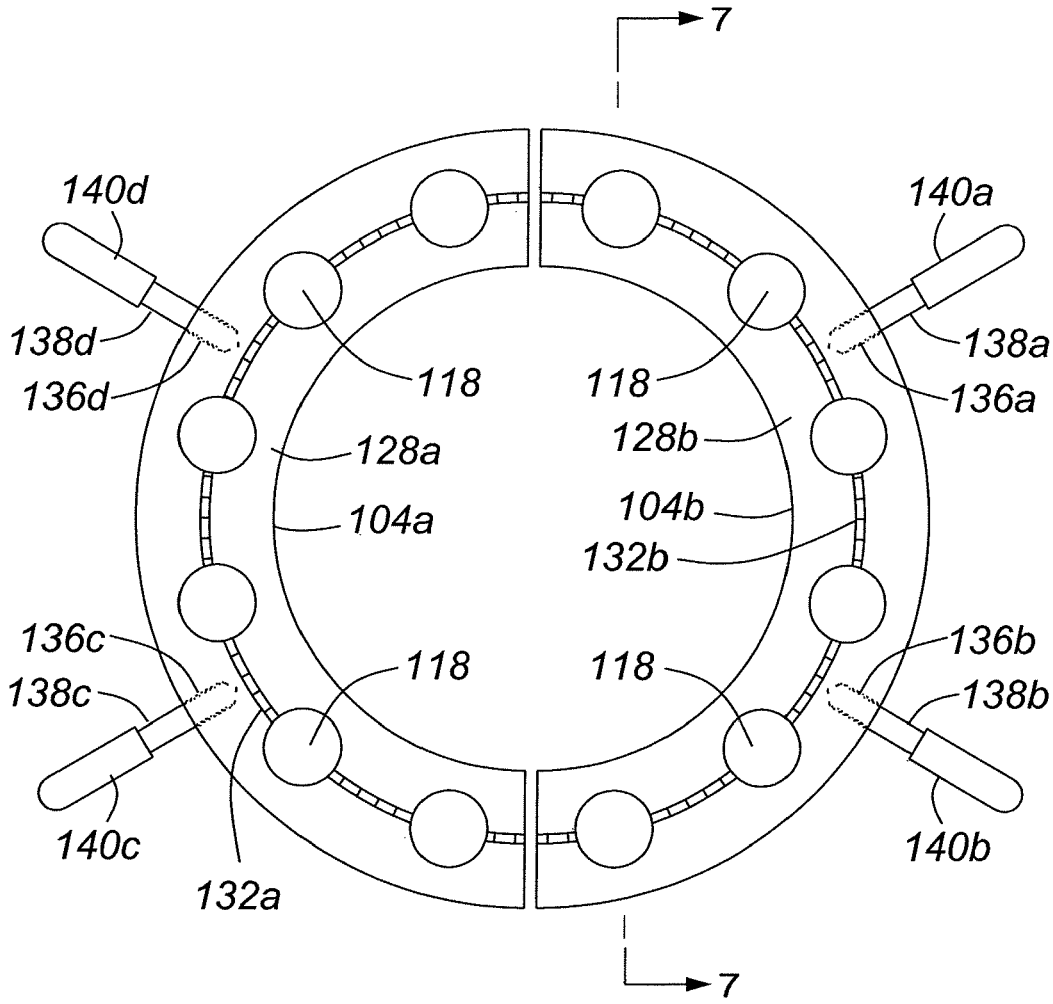
FIG. 6 is a schematic diagram of one embodiment of tie plates for the snubber spool shown in top plan view.

FIG. 6 is a schematic diagram shown in top plan view of one embodiment of tie plates 104*a* and 104*b* for the snubber spool 100. In this embodiment, the respective tie plates 104*a*, 104*b* are semicircular. It should be understood by those skilled in the art, however, that the shape of the outer edge of the tie plates is not important and a matter of design choice. In this embodiment, each tie plate 104*a*, 104*b* is provisioned with handles 138*a*, 138*b*, 138*c* and 138*d* to facilitate handling. Each handle has a threaded end 136*a*, 136*b*, 136*c* and 136*d* received in a threaded bore in a side surface of the respective tie plates 104*a* and 104*b*. In this embodiment, each handle is provided with a knurled grip or the like, 140*a*, 140*b*, 140*c* and 140*d*. The handles permit the tie plates 104*a*, 104*b* to be easily lifted off the base plates when the tie plates are being removed from the snubber spool 100.

Figure 7:
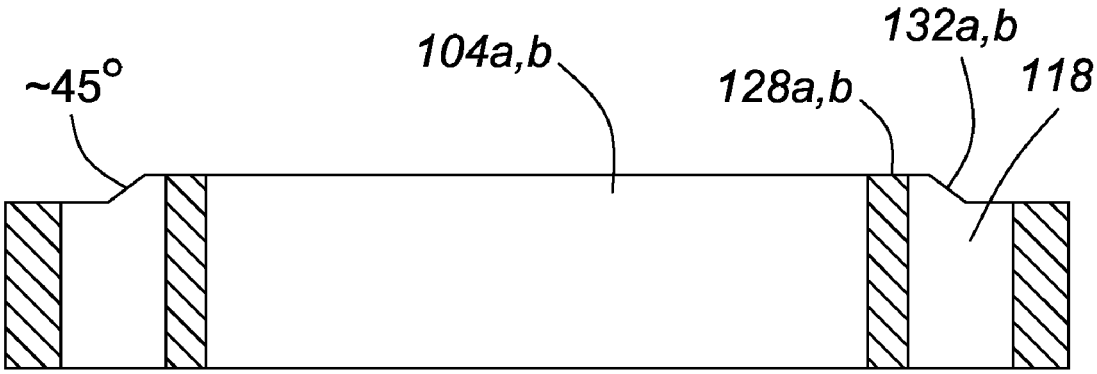
FIG. 7 is a schematic diagram of a cross-sectional view the tie plates taken along lines 7-7 of FIG. 6.

FIG. 7 is a schematic diagram of a cross-sectional view the tie plate 104*b* taken along lines 7-7 of FIG. 6. As explained above, each tie plate 104*a*, 104*b* includes a tie plate ridge 128*a*, 128*b* and a tie plate ramp 132*a*, 132*b*. The tie plate ramps 132*a*, 132*b* in one embodiment of the invention are inclined at an angle of about 45°, though within logical limits the angle of inclination is not critical to the function of the tie plate ramps 132*a*, 132*b*.

Figure 8:
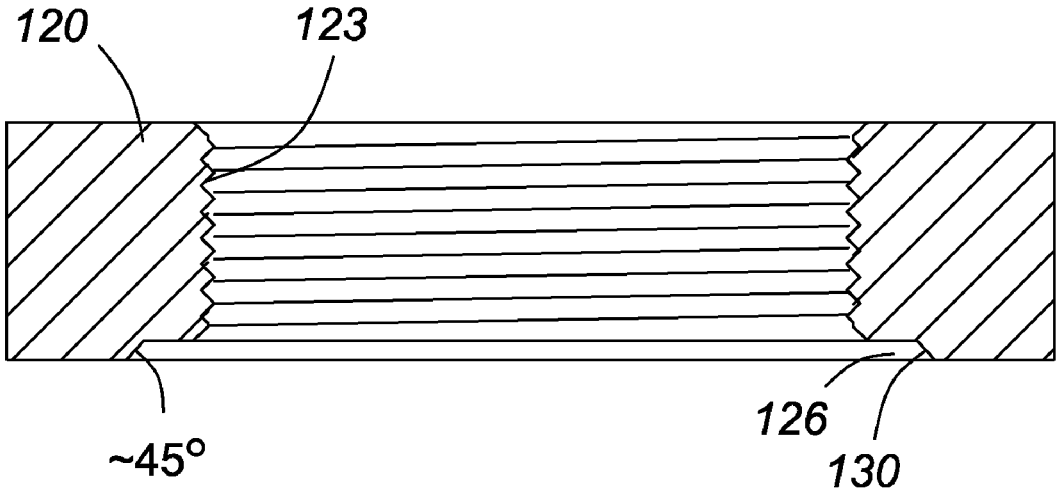
FIG. 8 is a cross-sectional view of one embodiment of a load nut in accordance with the invention, taken along lines 8-8 of the FIG. 9.
Figure 9:
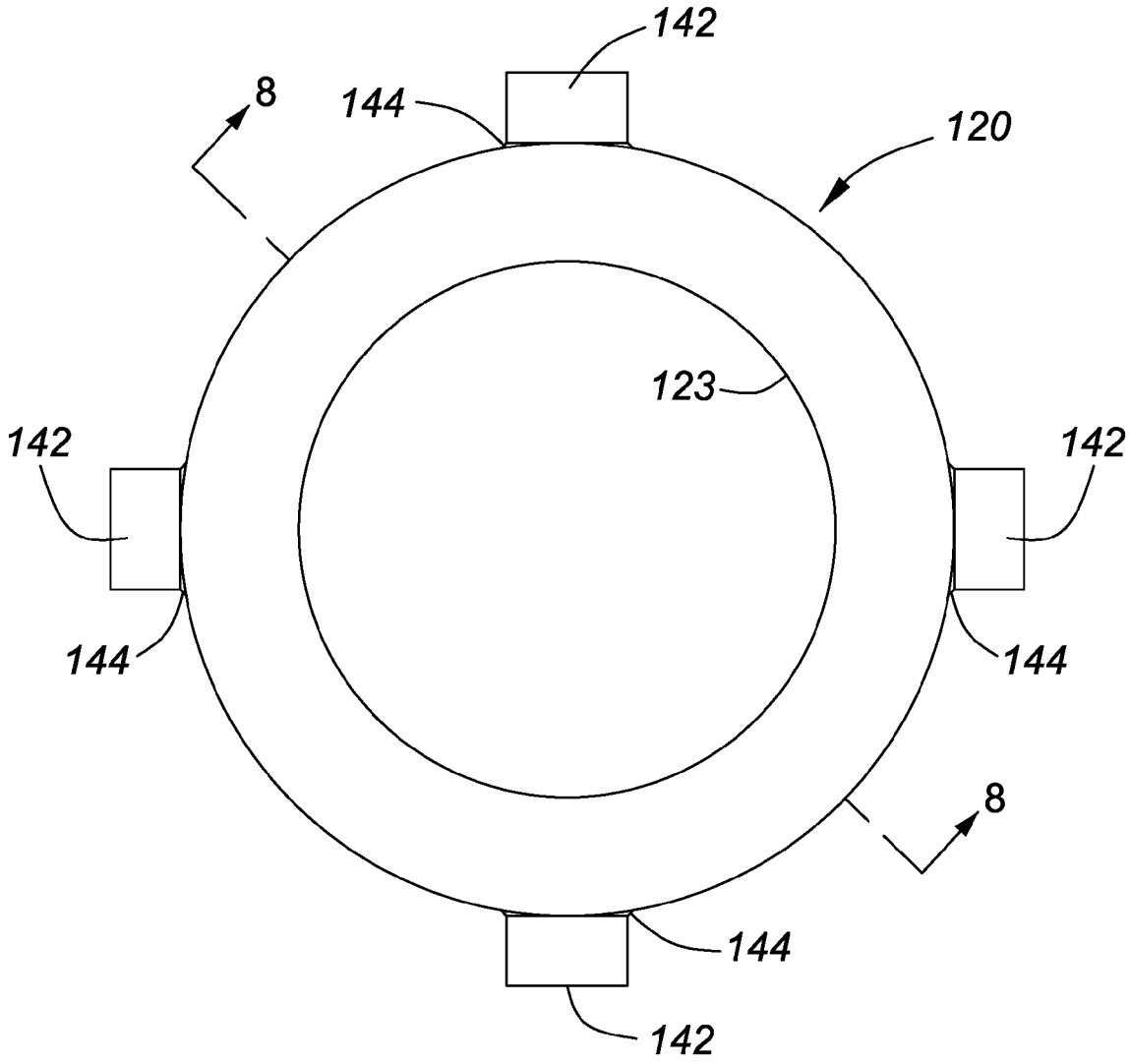
FIG. 9 is a schematic diagram in top plan view of one embodiment of the load nut in accordance with the invention.

FIG. 8 is a cross-sectional view of one embodiment of the load nut 120 in accordance with the invention, taken along lines 8-8 of FIG. 9. As explained above, the load nut 120 has the box thread 123 that engages the pin thread 122 on the outer sidewall 101 of the snubber spool 100 (see FIG. 3). The load nut 120 further includes the tie plate cavity 126 with the load nut ramp 130 around an outer periphery of the tie plate cavity 126. The load nut ramp 130 is inclined at an angle that corresponds to the angle of the tie plate ramps 132*a*, 132*b* (FIG. 6). In one embodiment, the inclination of the load nut ramp 130 is about 45° with respect to the bottom surface 124 (see FIG. 3) of the load nut 120.

FIG. 9 is a schematic diagram in top plan view of the load nut 120 shown in FIG. 8. In this embodiment, the load nut 120 is a hammer nut, sometimes referred to as a "wing nut", which is well known in the art. A plurality of hammer lugs 142 are welded at 144 to an outer periphery of the load nut 120. As will be understood by those skilled in the art, the number of hammer lugs provided is a matter of design choice. As will be further understood by those skilled in the art, the load nut 120 may be a spanner nut, which is also well known in the art.

The embodiments of the invention described above are intended to be only exemplary of the snubber spool with detachable base plates in accordance with the invention, and not a complete description of every possible form or configuration of the snubber spool or the base plates. The scope of the invention is therefore intended to be limited solely by the scope of the appended claims.

I claim:

1. A snubber spool with detachable base plates, comprising:

a base flange affixed to an outer sidewall of the snubber spool, the base flange supporting a plurality of spaced-apart load pins that are secured to the base flange and extend above a top surface of the base flange;

at least two base plates respectively having inner ends with a plurality of through bores respectively located to respectively receive one of the load pins when the inner ends of the at least two base plates are placed on the top surface of the base flange;

at least two tie plates respectively having a plurality of bores respectively located to respectively receive one of the top ends of the respective load pins when the at least two tie plates are placed on the inner ends of the at least two base plates; and a load nut having a box thread that engages a pin thread on the outer sidewall of the snubber spool above the base flange;

whereby the base plates are mounted over the load pins in a first orientation, the tie plates are mounted over the load pins in a second orientation different from the first orientation, and the load nut is tightened over the tie plates to lock the base plates to the snubber spool.

2. The snubber spool as claimed in claim 1 wherein a bottom surface of the load nut comprises a tie plate cavity with a load nut ramp along an outer periphery of the tie plate cavity.

3. The snubber spool as claimed in claim 2 wherein a top surface of the respective tie plates comprises a tie plate ridge that is received in the tie plate cavity, and a tie plate ramp along an outer periphery of the tie plate ridge.

4. The snubber spool as claimed in claim 3 wherein the load nut ramp contacts the tie plate ramp to urge the tie plates towards the outer sidewall of the snubber spool when the load nut is tightened down over the tie plates.

5. The snubber spool as claimed in claim 1 wherein the load pins are equally spaced-apart around a periphery of the snubber spool to permit the base plates to be mounted to the snubber spool in any axial orientation.

6. The snubber spool as claimed in claim 1 wherein the tie plates are semicircular.

7. The snubber spool as claimed in claim 1 wherein the bores in the tie plates are through bores.

8. The snubber spool as claimed in claim 1 wherein the load nut is a hammer nut.

9. The snubber spool as claimed in claim 1 wherein the base plates respectively comprise a through bore in their outer end to permit a superstructure to be detachably connected to the snubber spool.

10. The snubber spool as claimed in claim 1 wherein the load pins have pin threaded ends that engage box threaded bores in the base flange.

11. A snubber spool with detachable base plates, comprising:

a base flange on an outer sidewall of the snubber spool, the base flange supporting a plurality of spaced-apart load pins that extend above a top surface of the base flange parallel to the outer sidewall;

at least two base plates respectively having inner ends shaped to collectively surround the outer sidewall of the snubber spool, the inner ends including a plurality of bores respectively located to respectively receive one of the load pins;

at least two tie plates respectively having inner ends shaped to collectively surround the outer sidewall of the snubber spool, the tie plates including a plurality of bores respectively located to respectively receive a top end of one of the load pins; and a load nut having a box thread that engages a pin thread on the outer sidewall of the snubber spool above the base flange;

whereby the at least two base plates are mounted over the load pins in a first orientation, the at least two tie plates are mounted over the load pins in a second orientation different from the first orientation, and the load nut is tightened over the at least two tie plates to lock the at least two base plates to the snubber spool.

12. The snubber spool as claimed in claim 11 wherein a bottom surface of the load nut comprises a tie plate cavity with a load nut ramp disposed along an outer periphery of the tie plate cavity, a top surface of the respective tie plates comprise a tie plate ridge with a tie plate ramp disposed along an outer periphery the tie plate ridge, and the tie plate cavity receives the tie plate ridge and the load nut ramp contacts the tie plate ramp to urge the at least two tie plates towards the outer sidewall of the snubber spool when the load nut is tightened down over the tie plates.

13. The snubber spool as claimed in claim 11 wherein the load pins are equally spaced-apart around a periphery of the snubber spool to permit the at least two base plates to be mounted to the snubber spool in any radial orientation with respect to the snubber spool.

14. The snubber spool as claimed in claim 11 wherein the at least two tie plates are semicircular.

15. The snubber spool as claimed in claim 11 wherein the bores in the at least two tie plates are through bores.

16. The snubber spool as claimed in claim 11 wherein the load nut is a hammer nut.

17. The snubber spool as claimed in claim 11 wherein the at least two base plates respectively comprise a through bore in their outer end in which a quick-connect anchor pin is secured.

18. Detachable base plates for a snubber spool having a base flange on an outer sidewall of the snubber spool with a plurality of load pins retained by a base flange and a load nut having a box thread that engages a pin thread on the outer sidewall of the snubber spool above the base flange, the detachable base plates comprising:

at least two base plates respectively having inner ends with a plurality of through bores respectively located to collectively receive a respective one of the plurality of load pins; and at least two tie plates respectively having a plurality of bores respectively located to respectively receive one of the load pins;

whereby the at least two base plates are mounted over the load pins, the tie plates are mounted over the load pins so that joints between the at least two tie plates do not coincide with joints between the at least two base plates, and the load nut is tightened over the tie plates to lock the base plates to the load flange of the snubber spool.

19. The detachable base plates as claimed in claim 18 wherein a top surface of each of the at least two tie plates respectively comprises a tie plate ridge with a peripheral tie plate ramp, and a load nut ramp along a peripheral edge of a tie plate cavity in a bottom surface of the load nut engages the tie plate ramp when the load nut is tightened over the at least two tie plates to urge the respective tie plates towards the outer sidewall of the snubber spool when the load nut is tightened over the at least two tie plates.

20. The detachable base plates as claimed in claim 18 wherein the at least two base plates are substantially rectangular and the at least two tie plates are substantially semicircular.

* * * * *